US008397616B2

(12) United States Patent
Schmees et al.

(10) Patent No.: US 8,397,616 B2
(45) Date of Patent: Mar. 19, 2013

(54) TUBE WEAPON

(75) Inventors: Heiner Schmees, Celle (DE); Ralf-Joachim Herrmann, Wusterhausen (DE)

(73) Assignee: Rheinmentall Waffe Munition GmbH, Unterluss (DE)

( * ) Notice: Subject to any disclaimer, the term of this patent is extended or adjusted under 35 U.S.C. 154(b) by 51 days.

(21) Appl. No.: 12/831,164

(22) Filed: Jul. 6, 2010

(65) Prior Publication Data

US 2011/0005376 A1 Jan. 13, 2011

(30) Foreign Application Priority Data

Jul. 7, 2009 (DE) ..... 10 2009 032 199

(51) Int. Cl.
*F41A 3/30* (2006.01)

(52) U.S. Cl. ..... 89/19

(58) Field of Classification Search ..... 42/75.01, 42/75.02, 75.1; 89/19, 20.2, 20.4, 21
See application file for complete search history.

(56) References Cited

U.S. PATENT DOCUMENTS

| | | | | |
|---|---|---|---|---|
| 1,065,341 | A * | 6/1913 | Browning | 42/75.02 |
| 1,122,125 | A * | 12/1914 | Johnson | 42/75.01 |
| 1,165,976 | A * | 12/1915 | Johnson | 42/75.01 |
| 1,393,057 | A * | 10/1921 | Vollmer | 89/16 |
| 6,000,313 | A | 12/1999 | Becker et al. | |
| 6,142,057 | A | 11/2000 | Schulze | |
| 6,575,266 | B1 | 6/2003 | Gehse et al. | |
| 2009/0126594 | A1 | 5/2009 | Stark et al. | |

FOREIGN PATENT DOCUMENTS

DE 199 18 303 C2 6/2002

OTHER PUBLICATIONS

Rheinmetal "Technical Weaponry Pocket Edition," 7th Edition 1985, pp. 301-305, in German text. The English translation is attached on pp. 327-333.
Karl Heinz Bodlien, "Artillery Projects of the Future," Soldat Und Technik, (1974) pp. 10-15.
www.afji.com/blackwater/?s=2003_main2, Armed Forces Journal webpage, downloaded Jun. 21, 2010.
Technical Weaponry Pocket Edition, 7th Edition 1985, and its english translation.
M256 120 mm Smoothbore Gun, at http://www.inetres.com/gp/military/cv/weapon/M256.html (last updated Apr. 6, 2009), filed herewith as Exhibit A.

* cited by examiner

*Primary Examiner* — Stephen M Johnson
(74) *Attorney, Agent, or Firm* — Griffin & Szipl, P.C.

(57) ABSTRACT

A tube weapon comprises a weapon tube arranged in an exchangeable fashion using screw thread at a breech block of the tube weapon, and a cradle tube in which the weapon tube is axially and displaceably positioned. Despite using screw thread for connecting the weapon tube with the breech end, prevention of axial, and preferably also radial play, are assured, whereby the weapon tube is removable via a cradle tube in front of the breech block. The weapon tube is preloaded in the stress direction, which occurs with firing stress, by a screw thread ring arranged in front at the breech block. The screw thread ring encircles the weapon tube and is preferably partially screwed in detachable fashion into the anterior end of the breech block, and efficiently supports itself, axially, with its anterior end located against a collar of the weapon tube.

7 Claims, 2 Drawing Sheets

TUBE WEAPON

This application claims priority from German Patent Application No. DE 10 2009 032 199.3, filed Jul. 7, 2009, the entire disclosure of which is incorporated herein by reference.

FIELD OF THE INVENTION

The invention relates to a tube weapon with a weapon tube, which is exchangeably arranged by means of screw thread at a breach block mechanism of the weapon, and with a cradle tube in which the weapon tube is positioned so as to be axially displaceable.

BACKGROUND OF THE INVENTION

It is known from DE 199 18 303 C2, that for tube weapons with an exchangeable weapon tube, a bayonet connection is used for attachment of the weapon tube at the breech block mechanism (containing the breech action), because such a connection permits particularly rapid tube exchange. When using such screw thread connections, it is a disadvantage that, for opening and closing of the bayonet connection, there must exist both axial play between the weapon tube and the breech block mechanism as well as the occurrence of radial play, which leads in the region of the bayonet screw thread to other than optimal support of the weapon tube in view of the pressure stress from firing a shot.

Attachment of the weapon tube in the breech block mechanism by a tension screw is also known from: Rheinmetal "Technical Weaponry Pocket Edition"—$7^{th}$ Edition 1985, page 301 f., wherein the tension screw is screwed from the front (seen in firing direction) into the breech block mechanism, thereby pressing against a collar at the rear end of the tube. It is a disadvantage, with this attachment of the weapon tube at the breech block mechanism, that due to the collar, which is required at the rear end of the tube, any exchange of the weapon tube is frequently highly time consuming because with tank guns, for example, the exchange is prevented by the cradle tube (i.e., gun elevation guide piece) and, therefore, one normally has to first disassemble the complete weapon system including cradle tube in order to exchange the weapon tube.

The present invention is based on the object of providing a tube weapon of the above-mentioned kind, for which, in spite of use of screw thread, no axial and preferably also no radial play exists so that it is possible to remove and install the weapon tube without dismantling the cradle tube.

SUMMARY OF THE INVENTION

The above objects are solved according to the invention by the characteristics of a tube weapon in accordance with a first embodiment, as well as by the characteristics of a tube weapon in accordance with a second embodiment. Additional, particularly beneficial embodiments of the invention are disclosed in the additional secondary embodiments.

More specifically, in accordance with the first embodiment of the present invention, a tube weapon with a weapon tube (2) is provided, wherein the weapon tube (2) is exchangeably arranged by means of screw thread (3) at a breech block mechanism (1) of the tube weapon, and the tube weapon is provided with a cradle tube (4), in which the weapon tube (2) is positioned in an axially displaceable manner, wherein a screw thread ring (6) encircling the weapon tube (2) is provided, which is partially screwed in detachable fashion into the anterior end of the breech block mechanism (1) facing the weapon tube muzzle and efficiently supports itself axially, with the anterior end (7) of the screw thread ring (6) positioned in front of the breech block mechanism (1) against a circumferential collar (8) of the weapon tube (2). In accordance with the second embodiment of the present invention, a tube weapon with a weapon tube (2) is provided, wherein the weapon tube (2) is exchangeably arranged by means of screw thread (3) at a breech block mechanism (1) of the tube weapon, and the tube weapon is provided with a cradle tube (4), in which the weapon tube (2) is positioned in an axially displaceable manner, wherein the weapon tube in a section in front of the anterior end of the breech block mechanism has an exterior screw thread (5'), on which a thread ring is rotatably positioned in such manner that the end of the thread ring facing the breech block mechanism efficiently supports itself axially, in the firing direction, against the anterior front surface of the breech block mechanism.

In accordance with a third embodiment of the present invention, the first embodiment and the second embodiment are modified so that the screw thread involves a bayonet thread (3) consisting of several thread segments. In accordance with a fourth embodiment of the present invention, the third embodiment is further modified so that the bayonet screw thread (3) is of saw tooth design, whereby the screw thread flanks (9) of the weapon tube (2) facing the circumferential collar (8) are obliquely arranged vis-à-vis their axis of the bore (10).

The invention is based, in essence, on the concept of preloading the weapon tube with a screw thread ring arranged in the front of the breech block mechanism in the direction of stress, which occurs during firing stress. To that end, the screw thread ring encircling the weapon tube can be partially screwed, in a detachable fashion, into the anterior end of the breech block facing the muzzle of the weapon tube so that the screw thread ring axially supports itself in force-locking manner, with its anterior end located in front of the breech block mechanism on a circumferential collar of the weapon tube. Alternatively, it may be provided that the weapon tube has an external screw thread in a section before the anterior end of the breech block mechanism, on which a rotatable screw thread ring is positioned in such manner that the end of the screw thread ring facing the breech block is pulled in the firing direction against the anterior frontal surface of the breech block mechanism and, thus, is axially supported in force-locking manner at the frontal surface.

In regard to a screw thread connection for attachment of the weapon tube to the breech block mechanism, it has shown itself as expedient, with respect to rapid and simple change of the weapon tube, to use a bayonet screw thread connection consisting of several screw thread segments, as disclosed, for example, in DE 199 18 303 C2. If required, however, (such as in the case of machine weapons), a screw thread connection may also be involved where the weapon tube and the breech block mechanism have corresponding continuous threaded treads in the connection area.

In order to achieve radial support in the area of the thread and for centering the weapon tube in the breech block mechanism, the thread flanks transmitting the firing forces are preferably arranged obliquely vis-à-vis the axis of the bore.

Additional details and benefits of the invention are apparent from the exemplary embodiment which follows, and which is explained with the use of the attached figure.

DETAILED DESCRIPTION OF THE INVENTION

Figure 1:
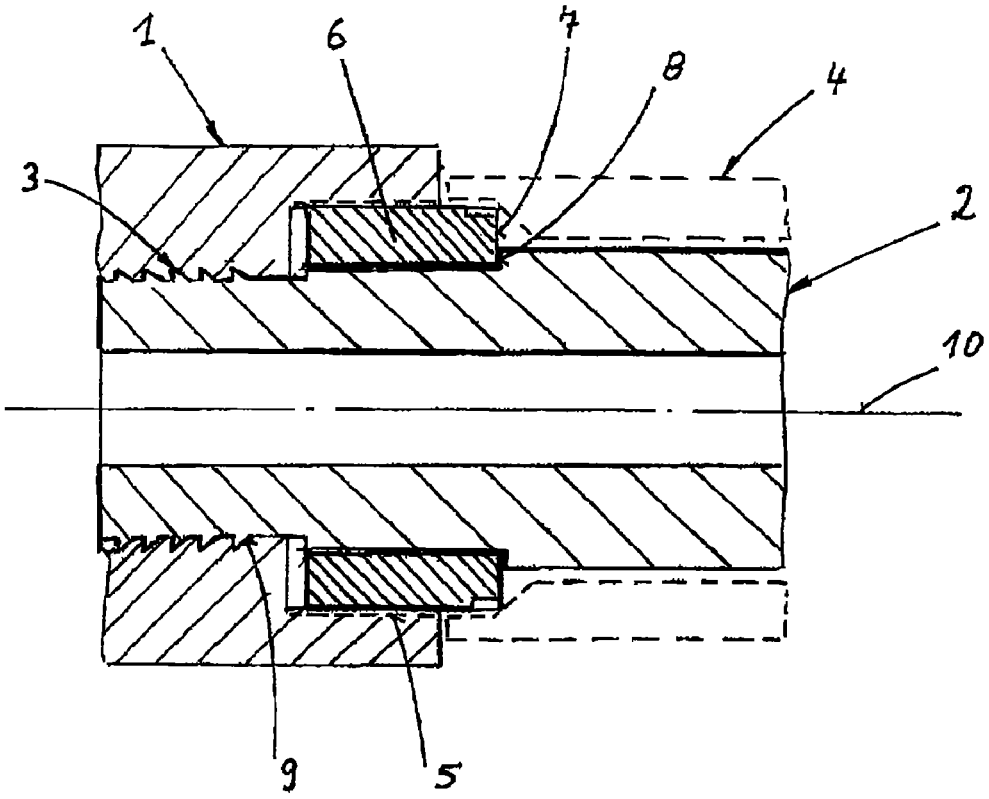
FIG. 1 of the attached figures shows an anterior portion of a breech block mechanism in accordance with a first embodiment of the present invention with, attached thereto, a weapon tube.
Figure 2:
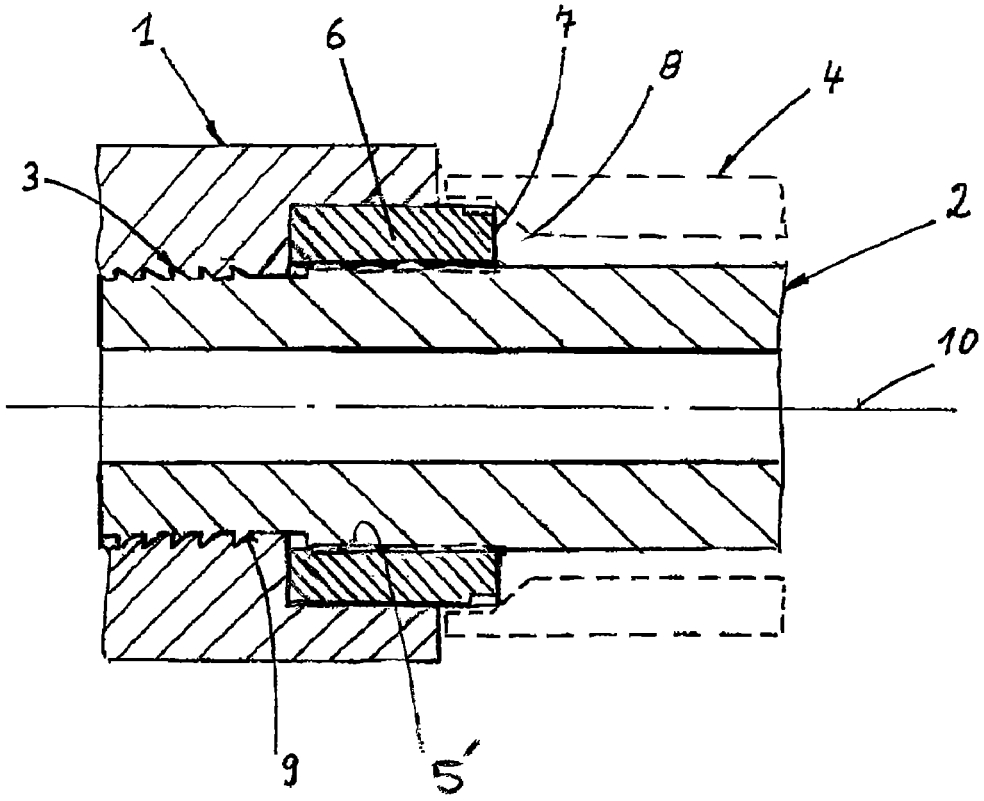
FIG. 2 of the attached figures shows a second embodiment of the present invention

FIG. 1 depicts the anterior part or portion of a breech block mechanism 1 with a weapon tube 2 of an armored car canon attached thereto. In this arrangement, the weapon tube 2 is connected in exchangeable fashion with the breech block 1 by means of a bayonet thread 3 consisting of several thread segments. The breech block mechanism 1 is connected in the front with a cradle tube 4, known per se (See, e.g., U.S. Pat. No. 6,142,057, which is incorporated herein by reference in its entirely), and indicated only by dotted lines (i.e., in phantom), in which the weapon tube 2 is positioned in a longitudinally displaceable manner on the armored car in order to facilitate recoil of the weapon tube after firing.

In the breech block 1, a screw thread 5 is provided in the front end thereof in the firing direction, into which a thread ring 6 is partially screwed in, which encircles the weapon tube 2. The anterior end 7 of the thread ring 6 is arranged before the breech block 1, and supports itself axially in a positive type manner (i.e., by a frictional connection) on a circumferential collar 8 of the weapon tube 2 in such fashion that the connection between the weapon tube 2 and the breech block 1 is pre-stressed in the stress direction (i.e., in the direction of firing stress), which occurs with firing stress and the play (i.e., axial play, and preferably also radial play) in the bayonet thread 3 is thus eliminated.

As is discernible from the figure, the bayonet thread 3 has a saw tooth shape design, with the thread flanks 9 of the weapon tube 2 facing the circumferential collar 8 and are obliquely arranged relative to the axis 10 of the bore of the weapon tube 2. The screw thread flanks 9 of the bayonet thread 3, which are in contact with each other and arranged obliquely vis-à-vis (i.e., in relation to) the axis 10 of the bore, provide both radial support for the weapon tube 2, as well as centering of weapon tube 2, in the breech block 1.

For assembly of the weapon tube 2 with the breech block 1, the weapon tube 2 is first pushed from the front (i.e., in opposite direction to the firing direction) through the cradle tube 4 and then rotated around its axis 10 of the bore to the extent until the segments of the bayonet thread 3 of weapon tube 2 and the breech block 1 cover, and engage with, each other in alignment. As shown in the Figure, the bayonet thread 3 of the weapon tube 2 is male thread, and the breech block 1 is provided with corresponding female thread for engaging with the male thread of the weapon tube 2.

With the aid of a device (not otherwise described herein), the weapon tube 2 is subsequently pushed, with the breech block 1 attached thereto, from its position of rest, counter to the firing direction, far out of the cradle tube 4 into an assembly position until the thread ring 6 completely protrudes tail-side from the cradle tube 4. The thread ring 6 is next turned using an appropriate tool in such a manner that the thread ring 6 closely presses against the collar 8 at the weapon tube 2. Finally, the weapon tube 2 is again pushed into its position of rest.

Disassembly of the weapon tube (2) is, in essence, done in reverse order, i.e., the weapon tube (2) is first shifted from its rest position into the assembly position, and then the force-fitting connection between weapon tube 2 and breech block 1 is eliminated by rotation of the thread ring 6, whereby the anterior end 7 of thread ring 6 displaces itself vis-à-vis (i.e., in relation to) collar 8 on the tail side. The weapon tube 2 is then subsequently separated from the breech block 1 by rotation around its axis 10 of the bore and pulled in the front out of the cradle tube 4.

LISTING OF REFERENCE NUMERALS

1. Breech Block
2. Weapon Tube
3. Thread, Bayonet thread
4. Cradle Tube
5. Screw Thread
6. Screw Thread Ring
7. anterior End (screw thread ring)
8. Collar of the Weapon Tube
9. Screw Thread Flank
10. Axis of the Bore of the Weapons Tube

The invention claimed is:

1. A tube weapon, comprising:
(a) a breech block having an anterior end;
(b) a weapon tube exchangeably connected by screw thread to the anterior end of the breech block;
(c) a cradle tube in which the weapon tube is disposed, wherein the weapon tube is axially displaceable within the cradle tube; and
(d) a screw thread ring disposed directly on an external surface of the weapon tube, wherein the screw thread ring is partially screwed into a recess located in the anterior end of the breech block so as to be at least partially enclosed within the recess, wherein an anterior end of the screw thread ring is positioned against a circumferential collar of the weapon tube so that the anterior end of the screw thread ring axially supports the screw thread ring in a force-locking manner due to a frictional connection that eliminates axial play.

2. A tube weapon according to claim 1, wherein the screw thread connecting the weapon tube to the anterior end of the breech block comprises a bayonet thread consisting of a plurality of thread segments.

3. A tube weapon according to claim 2, wherein the bayonet thread is of saw tooth shape, wherein screw thread flanks of the screw threads on the weapon tube are angled toward the circumferential collar and are obliquely angled in relation to an axis of a bore of the weapon tube.

4. A tube weapon, comprising:
(a) a breech block having an anterior end;
(b) a weapon tube that is exchangeably connected by screw thread to the anterior end of the breech block;
(c) a cradle tube in which the weapon tube is disposed, wherein the weapon tube is axially displaceable within the cradle tube, wherein the weapon tube, in a section in front of the anterior end of the breech block, has an exterior screw thread; and
(d) a screw thread ring rotatably positioned directly on the exterior screw thread of the weapon tube so that a first end of the screw thread ring faces the breech block and a second anterior end of the screw thread ring is positioned against a circumferential collar of the weapon tube so that the first end is pulled in a firing direction to engage against an anterior front surface of the breech block so as to axially support the screw thread ring in a force-locking manner due to a frictional connection that eliminates axial play.

5. A tube weapon according to claim 4, wherein the screw thread connecting the weapon tube to an anterior end of the breech block comprises a bayonet thread consisting of a plurality of thread segments.

6. A tube weapon according to claim 5, wherein the bayonet thread is of saw tooth shape, wherein screw thread flanks of the screw threads on the weapon tube are obliquely angled in relation to an axis of a bore of the weapon tube.

7. A tube weapon according to claim 4, wherein the second anterior end of the screw thread ring is positioned against the circumferential collar of the weapon tube so that first end is pulled in the firing direction to engage against the anterior front surface of the breech block so as to axially support the screw thread ring in the force-locking manner due to the frictional connection that eliminates both the axial play and radial play.

* * * * *